United States Patent [19]

Bray

[11] 4,401,046

[45] Aug. 30, 1983

[54] PNEUMATIC THREAD UNDERCUTTER

[76] Inventor: Murel B. Bray, 3112 Rosa Ave., El Paso, Tex. 79905

[21] Appl. No.: 290,062

[22] Filed: Aug. 4, 1981

[51] Int. Cl.[3] ..... D05B 65/02

[52] U.S. Cl. ..... 112/298

[58] Field of Search ..... 112/298, 291, 292, 293, 112/295, 296, 301

[56] References Cited

U.S. PATENT DOCUMENTS

| | | | |
|---|---|---|---|
| 1,450,531 | 4/1923 | Weis . | |
| 1,878,480 | 9/1932 | Fifield . | |
| 3,051,111 | 8/1962 | Cortese et al. . | |
| 3,403,648 | 10/1968 | Jarrett . | |
| 3,418,953 | 12/1968 | Fowler . | |
| 3,859,940 | 1/1975 | Nakamura . | |
| 4,200,050 | 4/1980 | Bianchi . | |
| 4,202,286 | 5/1980 | Costas | 112/301 X |

FOREIGN PATENT DOCUMENTS

| | | | |
|---|---|---|---|
| 2040846 | 2/1972 | Fed. Rep. of Germany | 112/298 |
| 2045292 | 10/1980 | United Kingdom | 112/298 |

*Primary Examiner*—Werner H. Schroeder
*Assistant Examiner*—Andrew M. Falik
*Attorney, Agent, or Firm*—Victor J. Evans & Co.

[57] ABSTRACT

A pneumatic thread undercutter to sever both the needle thread and the bobbin thread in a lock stitch type sewing machine. The apparatus works in conjunction with a pneumatically controlled sewing machine, and includes a frame disposed beneath a sewing area surface, a pneumatic cylinder carried on the frame having an extensible rod upon which a moving blade is operatively connected so as to translate in a reciprocal lateral manner. The moving blade includes a cutting notch, a pull hook and anvil hook orifice cooperating with a ramp area on a bobbin case to engage both the bobbin thread and needle thread such that one thread is cut before the other. A stationary knife is included to cut the second of the two threads so that at the end of a predetermined sewing endeavor the thread attached to a work piece can be expeditiously cut and a second work piece can be engaged in a rapid manner.

20 Claims, 4 Drawing Figures

PNEUMATIC THREAD UNDERCUTTER

BACKGROUND OF THE INVENTION

The present invention relates generally to a thread cutting device for lock stitch sewing machines which are pneumatically controlled.

The desirability of providing a sewing machine having an integral thread cutting mechanism associated therewith has been long recognized in the art. In this manner, an operator can advance from one work piece to a successive work piece in a minimal amount of time without having to perform operations not truly directed to high production techniques. To this end, attempts have been made to provide thread cutting mechanisms which are reliable in use and not only provide the residual needle and bobbin threads from the preceding work piece to be at a minimal length, but also allow the sewing machine to be oriented and adapted to engage a successive work piece without having to adjust or re-thread the machine in any manner.

The following patents reflect the state of the art of which applicant is aware, in so far as these references appear germane to the patent process:

U.S. Pat. Nos. 1,450,531 Weis;
1,878,480 Fifield;
3,051,111 Cortese et al.;
3,403,648 Jarrett;
3,418,953 Fowler;
3,859,940 Nakamura;
4,200,050 Bianchi.

Of these references, the Cortese et al. patent is directed to a sewing machine thread cutter wherein cutting of the sewing thread is obtained by a breaking action utilizing a device actuated by a predetermined overthrow designed into the stop motion mechanism which stops the sewing machine when the sewing cycle is completed.

The Bianchi patent relates to a thread cutting device for a sewing machine which includes a catcher member having a notched plate for catching the needle thread together with a small foil providing a bobbin thread catching zone and a bobbin and needle cutting zone.

The Nakamura patent relates to a thread cutting device for a sewing machine wherein a thread cutting cam is arranged for rotation with the main shaft together with a reciprocal shifter and a thread cutting mechanism for shearing a thread in accordance with a reciprocal movement of the shifter.

The Weiss patent relates to a thread breaking mechanism wherein the pull of the feed rolls for the fabric breaks the needle thread loop across the under edge of a looper blade and the bottom thread is broken across a breaker plate upon completion of the backward movement of the breaker slide.

The Fifield patent relates to a thread cutting mechanism for sewing machines for severing both the needle and bobbin threads on the machine. In the Fifield structure, a cutter blade 52 passes over a stationary blade 54 in a bobbin thread pull-off and severing device connected to the work-clamp opening mechanism together with needle-loop detaining and severing means including a pair of superposed pointed blades 63, 64.

The Fowler patent is directed to an automatic thread cutting attachment for an industrial sewing machine which is driven by a feed dog activating bar. A bracket attached to the feed dog activating bar supports a pivotal lever which is reciprocated at one end and which at the other end actuates the movable blade of the thread cutter.

The Jarrett patent discloses an attachment for a sewing machine which includes a device for pulling a loop in the thread adjacent the bobbin which is tensioned for severing substantially simultaneously with the severing of the tail. Jarrett provides an air cylinder 38 for pivotally reciprocating a knife 35. A thread looping device is also provided having a thread hook 32 which sweeps past the needle aperature 31 for engagement with the thread extending down from the needle to the bobbin so as to pull a loop in the thread. The sewing action of the needle, clamping action of the arch clamp, the cutting action of the knife in a horizontal plane and the looping function of the thread hooks are all coordinated so that they operate in proper sequence for bar tacking and severing.

By way of contrast, the instant application is directed to and specifies a pneumatic thread undercutting device for use in conjunction with a pneumatic type of needle positioner similar to the one disclosed in my pending application U.S. Ser. No. 244,589 entitled NEEDLE POSITIONER FOR SEWING MACHINE, which has advantages and benefits not contemplated by the prior art, while simultaneously overcoming disadvantages inherent therewithin. The undercutter includes a frame disposed beneath a sewing area surface, pneumatic means carried on the frame having an extensible rod and a moving blade operatively connected to the extensible rod so as to reciprocally and laterally translate in a linear fashion; a stationary blade associated with the moving blade in such a manner that of the two threads is initially severed by the moving blade, the second thread being severed by the stationary blade and appropriate structure for the bobbin and moving and stationary blades are provided so as to assure predetermined lengths of the needle and bobbin threads so that not only will the initial work piece not have an objectionable threaded terminus requiring subsequent snipping, but the successive work piece will be able to enter the machine without any further adjustments by the operator. In this manner, the volume of work can be increased on the machine.

Equally important, the vertical dispostion of the apparatus of the instant application removes the device so that should a needle break and fall below the sewing surface, the broken needle part will not become entrained in the cutting mechanism, thereby obviating any mechanical damage or inordinate repairs, and providing a more reliable, easily repairable machine.

SUMMARY AND OBJECTS OF THE INVENTION

Accordingly, this invention has as an objective the provision of a pneumatic thread undercutter for sewing machines which can be manually actuated for initialization, and thereafter the control system of the pneumatic device operates the severing of the needle and bobbin threads in an optimal manner.

It is yet a further object of this invention to provide a device of the character described above in which the severing is of such a nature that the initial work piece requires substantially no further attention, and a successive work piece can be introduced into the machine immediately for the sewing operation without any adjustments or manipulations by the operator thereby providing an increased work throughput.

It is still a further object of this invention to provide a device of the character described above which is extremely reliable in use, safe in design and use, and durable in construction.

It is still a further object of this invention to provide a device of the character described above which allows the machine to operate at a maximum efficiency.

It is still a further object of this invention to provide a device of the character described above which lends itself to mass production techniques.

It is still a further object of this invention to provide a device of the character described above in which the quality of the stitching associated with the machine, especially at the beginning and end of a sewing cycle is increased in reliability.

These and other objects will be made manifest when considering the following detailed specification when taken in conjunction with the appended drawing figures in which there is provided a pneumatic thread undercutter for sewing machines and the like which includes a frame disposed beneath a sewing area surface, a pneumatic device carried on the frame having an extensible rod upon which is mounted a movable blade including a pull hook and an anvil hook orifice formed from one piece and a cutting notch disposed remotely therefrom, a new and modified bobbin casing including a ramp which encourages the needle thread and bobbin thread to lend itself to easy grasping by the moving blade, and an appropriate tensioning device applied to the moving blade as well as a tensioning device adjunct whereby the needle thread is initially cut, and the bobbin thread is extended in such a manner that a greater length thereof has been provided, the bobbin thread finally being severed by a stationary knife disposed adjacent the moving blade.

BRIEF DESCRIPTION OF THE DRAWING FIGURES

BRIEF DESCRIPTION OF THE PREFERRED EMBODIMENTS

Figure 1:
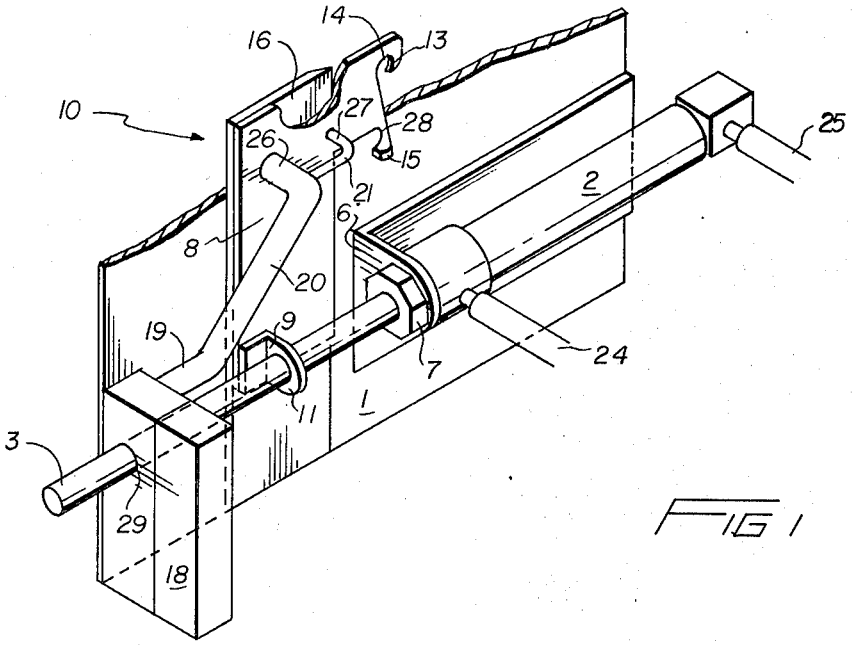
FIG. 1 is a perspective view of the pneumatic actuating device, its associated rod, spring tensioning means, spur means, the movable blade and the stationary knife.

Referring to the drawings now, wherein like reference numerals refer to like parts throughout the various drawing figures, reference numeral 10 is directed to the pneumatic bi-thread undercutter according to the present invention.

Figure 2:
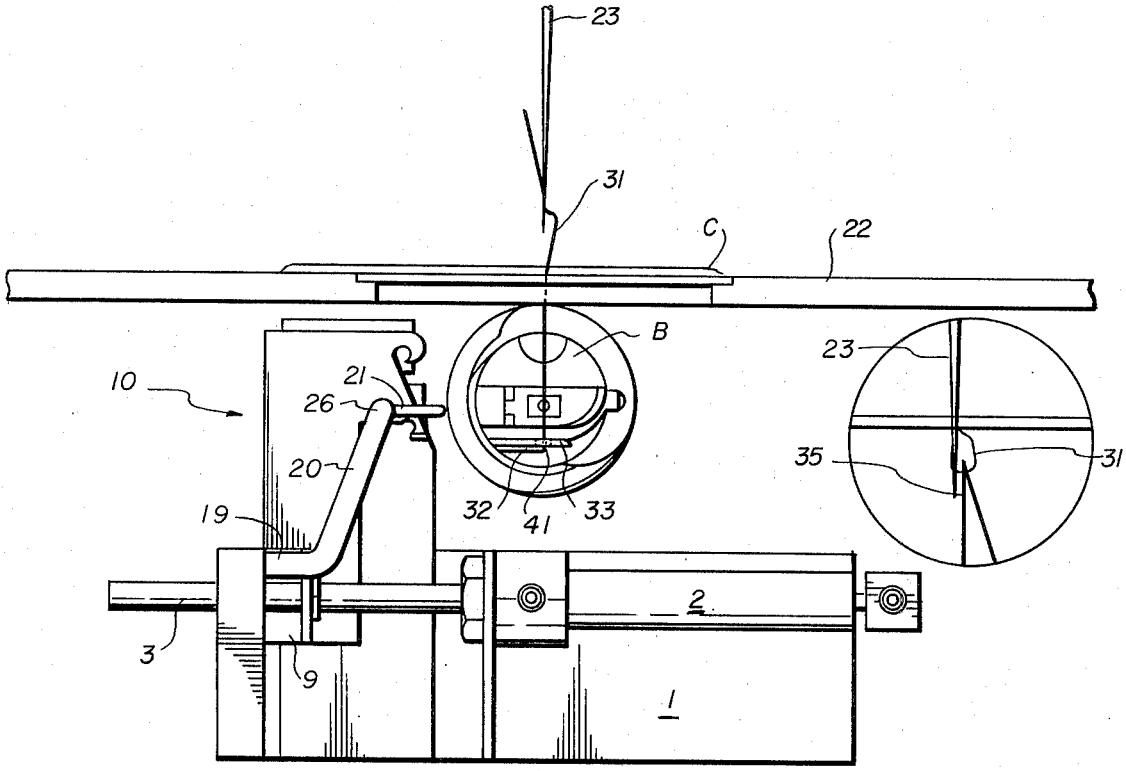
FIG. 2 is a front plan view of the device shown in FIG. 1 with the movable blade at its rest position, and shows details of the bobbin associated with the apparatus according to the present invention.
Figure 3:
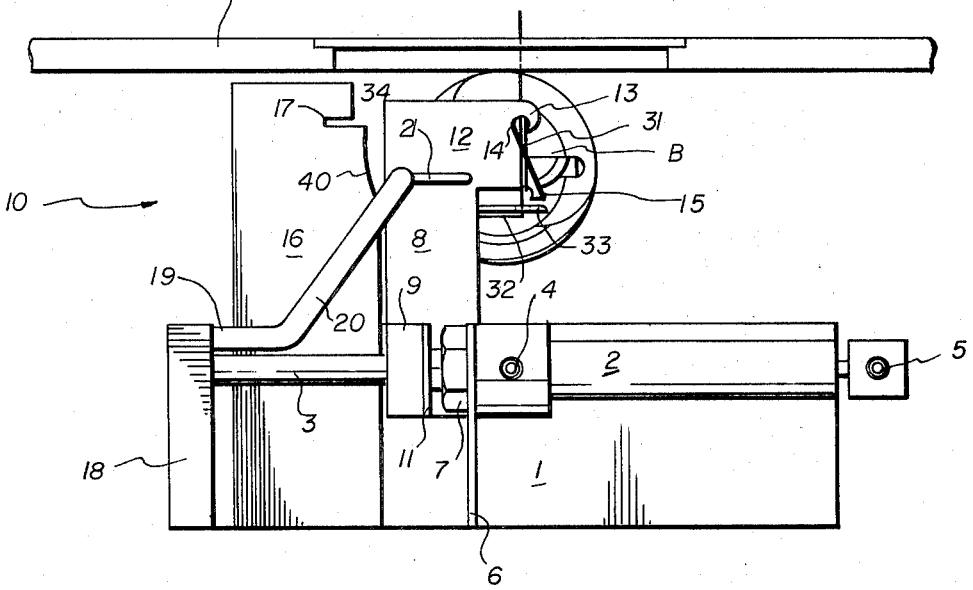
FIG. 3 is a view similar to FIG. 2 showing the movable blade in its extended position, in which the needle thread and bobbin thread are engaged by the moving blade.
Figure 4:
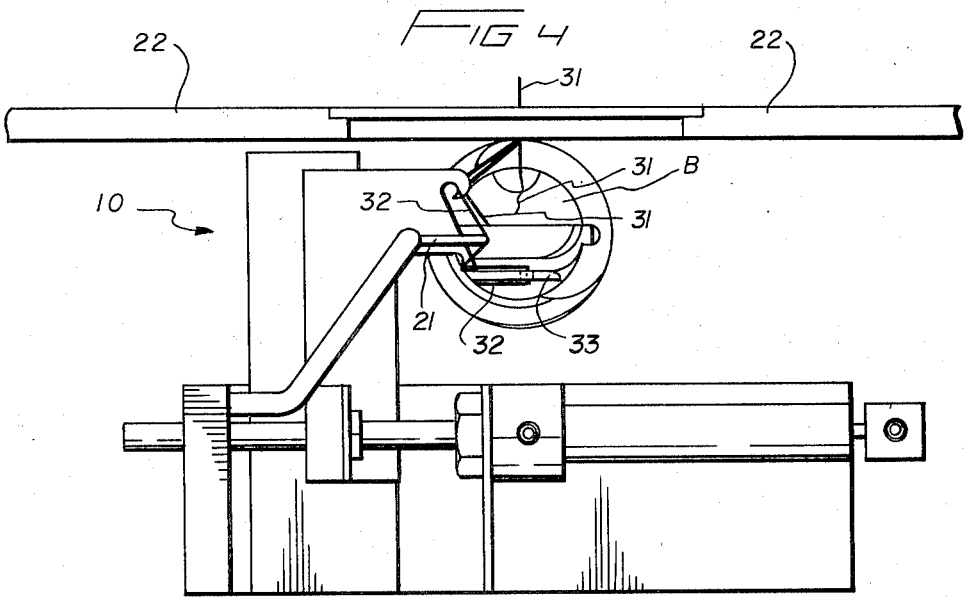
FIG. 4 is a view similar to FIGS. 2 and 3 showing the moving blade as it is retracted back to its rest position showing the engagement of the bobbin thread and the severed needle thread (31).

The undercutter 10 is shown especially well in FIGS. 2, 3 and 4 as being disposed beneath a sewing area surface 22 having an needle 23 adapted for vertical reciprocal downward motion through the sewing machine surface 22. The undercutter includes a vertical frame 1 upon which is disposed a pneumatic cylinder 2 having an extensible rod 3 slidably disposed within the cylinder 2 and a means for translating the extensible rod in a substantially horizontal plane defined by pneumatic orifices 4 and 5 operatively connected through conduits 24, 25 respectively to source of fluid drive, which in a preferred form is an air source. Thus, the extensible rod 3 is capable of horizontal, lateral, linear translation by selective admission of fluid into lines 24 or 25. The cylinder 2 is suitably supported upon the frame 1 by means of a flanged brace having an ear 6 extending therefrom, the ear 6 serving to support the cylinder by means of a threaded nut 7 disposed on one face of the ear, remote from the cylinder proper.

The frame 1 also includes an end plate 18 having a hole 29 extending therethrough, coaxial with the rod 3 so as to provide a guide and bearing surface for the extensible rod as best seen in FIG. 1. In addition, the frame has disposed thereon a movable blade 8 carried by the rod for similar horizontal, lateral reciprocal movement by virtue of its connection to the rod through ear member 11 attached to the moving blade as by tab 9. Accordingly, the lateral translation of the extensible rod as urged by the fluid within the cylinder 2 provides a concomitant translation of the moving blade 8.

A top portion of the blade 8 is provided with thread grasping and severing areas which as best shown in FIG. 1 includes a pull hook 13 integrally formed with an anvil hook orifice 14 disposed on a top leading edge of the movable blade 8. A lower leading edge has provided thereon a cutting notch 28 which includes an outwardly extending catch 15 for purposes to be assigned shortly.

As shown in FIG. 2, the movable blade 8 overlies a stationary knife 16 when the movable blade is at an at rest position. The orientation of the stationary knife relative to the moving blade is such that one is adjacent the other when at rest, and the blade and the knife are urged into tangential contact by means of tensioning device denoted in the drawings by reference numerals 19, 20 and 26. Specifically, the tensioning means includes an horizontally outwardly extending base support 19 eminating from the end plate 18 described hereinbefore, and an upwardly angulated branch member 20 terminates in a bearing surface 26 which is an inwardly directed cap portion that presses against the moving blade so that appropriate tension is applied to the moving blade when it contacts the stationary knife for benefits to be assigned shortly.

FIGS. 2 and 4 reveal especially well the structure of the modified bobbin case and its role in assisting the movable blade in capturing both the bobbin and needle thread and selectively shearing each at a predetermined time in a sequence of operations for the associated benefits in this application. Specifically, the modified bobbin case B includes a ramp 33 somewhat centrally disposed along a longitudinal axis such that the high part of the ramp is at the center. The bobbin thread 32 passes through an orifice in the ramp and is thence directed upwardly as is common for most bobbins. However, with the provision of the ramp 33, the needle thread 31 engaged by the rotating bobbin hook 35 while forming a loop through which the bobbin thread pases provides a lock stitching effect, and simultaneously causes the needle thread to be extended outwardly by virtue of its being redirected by the ramp 33 so as to allow the needle thread to slide over catch 15, around the bobbin thread, the moving blade 8, and into cutting notch 28 after the moving blade has extended to the right.

FIG. 2 depicts the situation in which the moving blade is about to be initialized and extended laterally to the right for engaging the threads, while FIG. 3 shows the moving blade 8 having engaged both the bobbin and the needle thread and the moving blade is preparing to retract, the condition for which is shown in FIG. 4. Specifically, on the retraction stroke, this is after the positioner has rotated the needle thread hook 360°, it is to be noted that both threads have been engaged by the anvil hook orifice 13, 14, and the bobbin thread by the pull hook 15. Retraction of the moving blade provides a severing of the needle thread 31 via cutting notch 28 as shown in FIG. 4. The bobbin thread is allowed to remain unsevered, it being preferred that the bobbin thread is severed by the stationary knife as will now be defined. The stationary blade 16 includes a cutting surface 34 and an underlying recess 17 of substantially rectangular configuration which extends thereafter to a concave leading edge of the knife 40 for extending downwardly into a substantially rectangular blank.

As pointed out before, the tensioning means is oriented in such a way that the motion of the blade 8 slides so that primary tension is not applied to the moving blade until it comes to its at rest position, in abutting relationship by virtue of the spring tension against the stationary knife 16. Formed as an adjunct to the spring tension, a spur extends horizontally outward, the spur 21 having an inwardly directed bearing surface 27 adapted to engage the moving blade 8 in a manner similar to the bearing surface 26 of the spring tensioning device. The spur 21 as best shown in FIG. 4 serves to engage the bobbin thread 32 so that subsequent additional retraction of the bobbin thread by virtue of its engagement with the pull hook 15 and anvil hook orifice 13, 14 causes additional thread to be paid out from the bobbin B until the bobbin thread comes in contact with the knife edge 34 on the stationary knife at which point the bobbin thread is severed, the length of which is of sufficient magnitude to allow the next successive work piece to be presented to the machine for sewing without any reinitialization of the machine by the operator.

In use and operation therefore, the following sequence of events is to be noted. This undercutter is designed not only for single needle but also double needle sewing machines preferably of the lock stitch type. In uses only one moving cutter blade 8 and one stationary cutting knife 16 to sever the bobbin and needle thread (31, 32 respectively) in one movement. Additionally, it is designed to be utilized with a pneumatic needle positioner. The cutter's moving blade 8 is powered by a double acting air cylinder 2 which initially holds the blade in an at rest position (FIG. 2), clear of the sewing machine's thread and machinery, while the machine is sewing.

To cut the thread from a item that has been sewed, the needle positioner is manually activated to move the needle into its up position (FIG. 2). With the needle in the up position, the cutter and positioner are manually activated by the cutter's air control valve, applying air to the cutter's air cylinder 2 and to the needle positioner.

As the moving blade 8 moves toward the bobbin case B, the needle positioner is in motion to make one 360° cycle. In making the one 360° cycle, the sewing machine's normal stitching function causes a needle thread loop to be formed around the cutter's moving notch 28 which is in its forward position. Briefly, the needle at the start of its upward movement (at 180°) forms a small loop that the rotating hook 35 picks up and pulls around the bobbin case, the moving blade 8, and bobbin thread in conjunction with the upward movement of the needle. In addition, and in conjunction with the raised ramp 33, the pull hook 15 and anvil hook orifice 14, 13 (FIG. 3) causes the bobbin and needle thread to be engaged as shown there. As pointed out above, the ramp 33 has an orifice 41 through which the bobbin thread 32 is disposed so as to hold the bobbin thread in place as the moving blade's pull hook 15 slides under the bobbin thread.

As the needle positioner completes its 360° cycle, and the needle is pulled into an upwardly retracted position, the needle thread is pulled taut against the cutter's moving blade 8 into the cutting notch 28 as well as the anvil hook orifice 14. Upon the needle positioner completing its 360° cycle, air is applied to the cutter's moving blade's air cylinder 2, reversing its direction, moving it to the rear to its static position. The cutter's moving blade moving rearwardly (FIG. 4) severs the needle thread 31 that has been pulled taut around the moving blade's cutting notch 28 and within the anvil hook orifice 14. Also, in the moving blade's rearward movement, the bobbin thread that has been linked within the moving blade's anvil hook orifice 14 and pull hook 15 is pulled rearwardly, pulling thread from the bobbin. Before the moving blade completes its rearward movement, the bobbin thread comes in contact with a spur 21, 17 that is affixed to the tension finger 19, 20, 26 so that in the cutter's at rest position (FIG. 2) the moving blade is held tight against the stationary blade while the spur which is affixed thereto increases the amount of thread that is being pulled from the bobbin case B to the minimum length of thread required for the needle thread loop to engage the next item to be stitched. Upon reaching the at rest position, the moving blade's anvil hook orifice makes impact with the stationary knife 34, severing the bobbin thread within the anvil hook orifice. This completes the cutting cycle, leaving the cutter and the needle positioner in the static at rest position out of the way of the sewing operation.

Thus, it can be seen, that in one complete cycle of the cutter in cooperation with one cycle of the needle, a device has been provided which automatically severs both the bobbin thread and the needle thread in such a manner that the initial article being worked on does not have an unduly lengthy stray open ended thread, thereby minimizing the amount of subsequent operations, while simultaneously providing the needle and bobbin threads in suitable orientation to address most efficiently a successive work piece.

Moreover, having thus described the invention, it should be apparent numerous structural modifications are contemplated as being a part of this invention as set forth hereinabove and as defined hereinbelow by the claims.

What is claimed is:

1. A pneumatic thread undercutter for sewing machines and the like comprising in combination:

a frame disposed beneath a sewing area surface, pneumatic means carried on said frame having an extensible rod means, a moving blade means operatively connected to said extensible rod means to reciprocally translate laterally therewith, said moving blade means provided with a cutting notch to sever a needle thread engaged thereby during lateral translation of said moving blade, a stationary knife supported on said frame oriented adjacent said moving blade when said moving blade is in a retracted at rest position, means on said moving blade to engage and retract a bobbin thread during a reciprocal lateral translation whereby the bobbin thread is severed by coaction of said moving blade against said stationary knife when said moving blade comes to rest, and tensioning means attached to said frame and applied to said moving blade to constrain said moving blade tight against said stationary knife for severing the bobbin thread.

2. The device of claim 1 including ramp means on a bobbin case holding the bobbin thread to urge the needle and bobbin threads into engagement with said moving blade.

3. The device of claim 2 wherein said ramp means is centrally disposed on the bobbin case, said ramp means including a central aperture through which the bobbin thread passes, a bobbin hook on the bobbin case causing the needle thread to form a loop through which the bobbin thread passes providing a lock stitching effect and simultaneously urging the needle thread outwardly for engagement with said moving blade.

4. The device of claim 3 including spur means affixed to said tension means oriented to contact the bobbin thread upon retraction of said moving blade to increase the length of bobbin thread paid out from said bobbin case.

5. The device of claim 4 wherein said means on said moving blade to engage and retract the bobbin thread comprises a pull hook on a leading edge thereof, and an anvil hook orifice on a top leading edge formed adjacent said pull hook thereof provided integrally therewith to assist in paying out and serving the bobbin thread against said stationary knife.

6. The device of claim 5 including a cutting notch on a lower leading edge of said moving blade and an outwardly extending catch emanating from said cutting notch which together catches the needle thread which slides over said catch and into said notch during cycling of said moving blade to cause the needle thread to loop around the bobbin thread.

7. The device of claim 6 wherein said tension means includes a horizontal base support portion emanating from said frame, a diagonally upwardly angulated branch member extending therefrom communicating with a bearing surface inwardly directed towards said moving blade.

8. The device of claim 2 including spur means affixed to said tension means oriented to contact the bobbin thread upon retraction of said moving blade to increase the length of bobbin thread paid out from said bobbin.

9. The device of claim 8 wherein said means on said moving blade to engage and retract the bobbin thread comprises a pull hook on a leading edge thereof, and an anvil hook orifice on a top leading edge formed adjacent said pull hook thereof provided integrally therewith to assist in paying out and and severing the bobbin thread against said stationary knife.

10. The device of claim 9 including a cutting notch on a lower leading edge of said moving blade and an outwardly extending catch emanating from said cutting notch which together catches the needle thread which slides over said catch and into said notch during cycling of said moving blade to cause the needle thread to loop around the bobbin thread.

11. The device of claim 1 including spur means affixed to said tension means oriented to contact the bobbin thread upon retraction of said moving blade to increase the length of bobbin thread paid out from said bobbin.

12. The device of claim 11 wherein said means on said moving blade to engage and retract the bobbin thread comprises a pull hook on a leading edge thereof, and an anvil hook orifice on a top leading edge formed adjacent said pull hook thereof provided integrally therewith to assist in paying out and severing the bobbin thread against said stationary knife.

13. The device of claim 11 including a cutting notch on a lower leading edge of said moving blade and an outwardly extending catch emanating from said cutting notch which together catches the needle thread which slides over said catch and into said notch during cycling of said moving blade to cause the needle thread to loop around the bobbin thread.

14. The device of claim 1 wherein said means on said moving blade to engage and retract the bobbin thread comprises a pull hook on a leading edge thereof, and an anvil hook orifice on a top leading edge formed adjacent said pull hook thereof provided integrally therewith to assist in paying out and severing the bobbin thread against said stationary knife.

15. The device of claim 14 including a cutting notch on a lower leading edge of said moving blade and an outwardly extending catch emanating from said cutting notch which together catches the needle thread which slides over said catch and into said notch during cycling of said moving blade to cause the needle thread to loop around the bobbin thread.

16. The device of claim 1 wherein said tension means includes a horizontal base support portion emanating from said frame, a diagonally upwardly angulated branch member extending therefrom communicating with a bearing surface inwardly directed towards said moving blade.

17. The device of claim 16, including ramp means on a bobbin case holding the bobbin thread to urge the needle and bobbin threads into engagement with said moving blade.

18. The device of claim 17, including spur means affixed to said tension means oriented to contact the bobbin thread upon retraction of said moving blade to increase the length of bobbin thread paid out from said bobbin.

19. The device of claim 18, wherein said means on said moving blade to engage and retract the bobbin thread comprises a pull hook on a leading edge thereof, and an anvil hook orifice on a top leading edge formed adjacent said pull hook thereof provided integrally therewith to assist in paying out and severing the bobbin thread against said stationary knife.

20. The device of claim 18 wherein said spur means comprises an "L" shaped member having one leg provided with a bearing surface and a second leg attached to said tension means.

* * * * *